US005699033A

United States Patent [19]

Hofsäss

[11] Patent Number: 5,699,033

[45] Date of Patent: Dec. 16, 1997

[54] INSULATING HOUSING WITH AN INNER SPACE FOR A THERMAL SWITCH HAVING CONTACTS FOR ELECTRICAL CONNECTION TO A HOLDER

[76] Inventor: Marcel Hofsäss, Bodelschwinghstr. 36, D-75179 Pforzheim, Germany

[21] Appl. No.: 610,163

[22] Filed: Feb. 29, 1996

[30] Foreign Application Priority Data

Mar. 3, 1995 [DE] Germany ..... 195 07 488.2
Dec. 9, 1995 [DE] Germany ..... 195 45 996.2

[51] Int. Cl.[6] ..... H01H 37/04

[52] U.S. Cl. ..... 337/380; 337/298; 337/383; 439/526

[58] Field of Search ..... 337/298, 327, 337/372, 380, 383, 398; 361/104, 105; 439/68, 70, 526; 200/16 E, 52 R

[56] References Cited

U.S. PATENT DOCUMENTS 3,031,565 4/1962 Appleton .

FOREIGN PATENT DOCUMENTS 0 315 262 A1 5/1989 European Pat. Off. .
0 638 982 A2 2/1995 European Pat. Off. .
8607370 U 5/1987 Germany .
38 17 080 A1 12/1988 Germany .
9004941 U 7/1991 Germany .
9004943 U 7/1991 Germany .
9214543 U 2/1993 Germany .
9301874 U 8/1993 Germany .

*Primary Examiner*—Leo P. Picard
*Assistant Examiner*—Jayprakash N. Gandhi
*Attorney, Agent, or Firm*—Harness, Dickey & Pierce, P.L.C.

[57] ABSTRACT

An insulating housing (41) with an inner space (42) to accommodate a switch (12) with temperature-dependent switching device which has to be mechanically and/or electrically protected is described. The switch (12) displays two electrically conductive terminal areas which ensure the electrical contact of the switch (12) to the contact parts (24, 25) of a holder (23) or an electrical consumer (57). The insulating housing (41) has at least one opening (46, 50) through which the contact parts (24, 25) make direct contact with the two terminal areas and clamp the switch (12) between them. The electrical consumer (57) hereby displays two contact parts (24, 25) which form a seat for the switch (12). Moreover, two terminal elements (58, 59) are provided to supply electricity to the consumer (57), whereby the first terminal element (59) and the first contact part (24) are directly connected to the consumer (57) whereas the second terminal element (58) is connected to the second contact part (25).

10 Claims, 2 Drawing Sheets

INSULATING HOUSING WITH AN INNER SPACE FOR A THERMAL SWITCH HAVING CONTACTS FOR ELECTRICAL CONNECTION TO A HOLDER

BACKGROUND OF THE INVENTION

The present invention relates to an insulating housing with an inner space to accommodate a switch with temperature-dependent switching device which has to be mechanically and/or electrically protected whereby the switch comprises two electrically conductive connection areas which ensure the electrical contact of the switch to the contact parts of a holder or an electrical consumer which has to be protected.

RELATED PRIOR ART

Such an insulating housing is known from DE 38 17 080 A1.

This publication discloses a temperature controller which has a switch with temperature-dependent switching device in an insulating housing. The insulating housing is designed so that it can be mounted on the terminals of a consumer to be monitored whereby two terminals similarly protrude from the insulating housing of the temperature controller itself which correspond to a desired terminal pattern. The known consumer in this publication does not have a standardised terminal pattern so that it cannot be supplied with power via a standardised plug. The consumer's terminal pattern is converted to the standardised terminal pattern via the insulating housing which contains complicated bent sheet metal parts which on the one hand make contact with the switching device housing and on the other represent terminal lugs or counter parts for the terminal lugs on the consumer or standardised plug.

On account of the necessary connection technology which connects the switching device inside the insulating housing to the external terminals, the known temperature controller is a very cost-intensive component since the connection technology normally has to be produced by manual labour.

A switch with a temperature-dependent switching device, such as can be used for example for the purpose of the present invention, is known from DE 29 17 482 C2. The switch displays a closed housing containing the switching device. The housing comprises an electrically conductive cover and electrically conductive base which is insulated from the cover. The electrical connection for the switch when fitted is made directly via the cover and base.

Such switches, also called temperature controllers, are used to monitor the working temperature and/or working current of an electrical consumer which has to be protected. If the working temperature of the consumer exceeds a certain limit value the switch opens, which for this purpose must be connected in series with the consumer in the supply circuit. Such switches can be of a self-holding design by providing parallel and/or serial resistors on the switch and may switch in the event of excessively high currents if the protective resistor heats up too much.

Such consumers are generally known from the state of the art. An increasing number of devices, particularly household devices, have electrical consumers, for example pumps in washing machines, motors for compressors in refrigerators and deep freezers, transformers for electrical equipment which are operated at a different voltage to the mains voltage, fan motors and heating spirals in hair dryers, etc.

There is an increasing trend to monitor the temperature development of the consumer for safety reasons, whereby the consumer is switched off in the event of overheating. Temperature controllers which have their own housing or supporting part and which are subsequently mounted on the consumer are used in such cases. These controller housings have bimetallic switching devices which are generally linked by two terminal lugs, connectors or pigtails, which themselves rest on the controller housing. Such a terminal element in the temperature controller is connected to a corresponding terminal element in the consumer whereby the second terminal element in the temperature controller and the second terminal element in the consumer are used to supply electricity to the consumer, which is thus connected in series with the temperature controller.

Such temperature controllers are usually special developments which have to be adapted to the consumer which is to be protected. Special attention must be paid here not only to the connection technology but also to a good thermal contact with the consumer to be monitored. This also leads to high costs in the construction and assembly of such temperature controllers. These costs are logically reflected in the end costs of the consumers protected by the temperature controller.

A further high cost factor is the assembly of the temperature controller on the consumer to be monitored wherever the plug-type technology explained above is not used. Pigtails often have to be soldered or inserted into terminal blocks during assembly and this also requires wage-intensive manual work.

A temperature controller is known from DE 90 04 941 U which displays a frame of plastic on the top and bottom of which an electrically conductive contact plate is snap fitted. There is a bimetallic switching device in the frame which is clamped between the contact plates. The contact is hereby made by pressing the upper contact plate against the cover and the lower contact plate against the base of the switching device.

The frame has snap-in projections which are overlapped by hook-like lugs on the control plates so that these snap-in locking devices exert a pressure on the top and bottom of the switching device.

When assembling the temperature controller the upper contact plate is first snapped in place on the frame before the switching device is inserted into the frame from below. The lower contact plate is then fitted from below so that the switching device is clamped tight between the two contact plates, whereby the snap-in projections on the frame parts form the counter support for the clamping forces.

A disadvantage of the known holder and the temperature controller assembled with this is that the mechanical tolerances of the sheet metal parts and the plastic frame must be very low so that the necessary contact forces can be applied. However, since these temperature controllers are mass-produced articles, the sheet metal parts and plastic frames are produced in very large numbers, whereby the tolerances cannot always be observed. Moreover, these individual parts are delivered to the manufacturers in large batches, whereby the sheet metal parts in the batch are often bent during transportation or loading/unloading.

All of these factors lead to a high spoilage during assembly of the known temperature controllers, which on the whole increases the manufacturing costs of the temperature controller. A further disadvantage of the known temperature controller relates to the necessary safe contact between the bimetallic switching device and the contact plates which form the external contacts. Since the contact forces are applied by bent lugs on the contact plates, this contact is often inadequate for long-term requirements since the high loads in everyday use, e.g. due to the continuous vibration of the devices protected by the temperature controller, weaken the snap-in locking device. The safe contact can no longer be guaranteed even after a very short service life particularly if the tolerances of the assembled components come together in an unfavourable constellation.

It is generally known that during the manufacture of such temperature controllers the connection technology, in other words the connection of the possibly encapsulated bimetallic switching device to the external terminals, is very wage intensive and requires the stockpiling of numerous individual parts. Moreover, the known temperature controllers or their holders can only be assembled manually, which not only entails high costs but also increases the number of rejects.

SUMMARY OF THE INVENTION

In view of the above it is an object of the present invention to improve the insulating housing of the kind mentioned at the outset with little constructional work to enable a fast and economical fitting of an insulating housing containing a temperature-dependent switch onto an electrical consumer.

This object is achieved by the invention with the insulating housing of the kind mentioned at the outset inasmuch as this displays at least one opening through which the contact parts make direct contact with the two terminal areas and clamp the switch between them.

The object underlying the invention is thus fully achieved.

The insulating housing is now designed in such a way that the switch only has to be inserted, following which the insulating housing is fitted on contact parts of the electrical consumer. These contact parts hereby make contact with the two terminal areas and thus with the temperature-dependent switching device inside the switch. The switch can be inserted into the insulating housing mechanically, whereby one possibility is to coat the switch with a correspondingly shaped insulating housing. Not only the production but also the final assembly and mounting on the electrical consumer to be protected or a corresponding holder are thus very simple, can be automated and are thus more economical and less susceptible to faults.

Accordingly, the electrical consumer mentioned is designed in such a way that two contact parts form a seat for the switch, one of the two terminal elements and one of the two contact parts are connected to the consumer and the other contact part is connected to the other terminal element.

The necessary "wiring" of the consumer can thus be carried out before mounting the temperature controller, which only has to be fitted onto the two contact parts with its insulating housing.

The new insulating housing thus provides a very simple connection technology which can be produced economically and with little spoilage.

It is then preferred if the insulating housing comprises an internal profile which presses the inserted contact parts against the connecting or terminal areas.

The advantage of this is that it is not the spring force of the contact parts which is responsible for the contact reliability but that this contact is at least aided by the internal profile of the insulating housing.

It is then further preferred if the insulating housing comprises at least one snap-in locking device via which it locks in place with a corresponding snap-in element on one of the contact parts.

The advantage of this is that the insulating housing and thus the switch contained therein are captured on the electrical consumer, whereby the retaining force does not depend on the contact force between the contact parts and the terminal areas.

It is furthermore preferred if the insulating housing captures an inserted switch, for which purpose it preferably has snap-in locking devices which has to be pressed over or passed by over-pressure, thus capturing the inserted switch.

The advantage of this is that a temperature controller consisting of an insulating housing and switch can be pre-assembled, the switch only has to be inserted into the insulating housing, where it is captured by the snap-in locking devices which has to be pressed over. Such temperature controllers can then be transported as bulk goods since the switches are mechanically protected by the insulating housings surrounding them. Of course, the switch can be inserted into the insulating housing by automatic production equipment.

It is then preferred if the insulating housing comprises guide channels or grooves for the contact parts whereby the guide channels or grooves preferably comprise a guide surface which is longitudinally inclined towards the inner space or a guide surface curved in a longitudinal direction.

This measure has a particular constructional advantage since the guide surfaces advantageously ensure a corresponding contact pressure of the contact parts on the terminal areas of the switch. The guide channels and/or grooves have the further advantage that the contact parts are guided when the insulating housing is fitted in place so that these cannot bend or break.

On the whole it is preferred if the insulating housing comprises a further opening through which the switch can be inserted, whereby the second opening is preferably vertical to the guide channels and/or grooves.

The advantage of this measure is that the switch is not only in contact with the contact parts which are inserted into the guide channels or grooves, but that it is also prevented from falling out of the insulating housing. This means that further snap-in locking devices, which hold the switch in an insulating housing which has not yet been mounted on a consumer, can be either fully dispensed with or weaker snap-in locking devices can be used which only ensure a safe mechanical hold of the switch inside the insulating housing during transportation of a housing which has not yet been mounted on a consumer. On the whole this simplifies not only the construction of the new insulating housing but also the necessary individual assembly steps.

It is hereby preferred if the insulating housing is made completely of plastic and is preferably an injection moulded plastic part.

The advantage of this is that the insulating housing can be manufactured in one very simple, economical injection process from one piece of material.

In the case of the electrical consumer it is also advantageous if the broad sides of the two contact parts face each other as terminal lugs onto which a new insulating housing containing a switch can be mounted so that very economical, universal terminal lugs can be used to make electrical contact with and mechanically hold the temperature controller consisting of insulating housing and switch.

In general the insulating housing can then be designed in such a way that the inserted switch is held loosely or clamped firmly by the snap-in locking devices. Contact is then only made with the switch by inserting the contact part or terminal lug of a holder or electrical consumer into the insulating housing, whereby the insulating housing itself ensures that the contact parts are pressed against the terminal areas of the switch and held firmly in place by its inner shape.

Further features and advantages can be derived from the following description.

It is understood that the aforementioned features and those to be explained in the following can be used not only in the specified combinations but also in other combinations or alone without going beyond the scope of the present invention.

BRIEF DESCRIPTION OF THE DRAWINGS

The invention is shown in the drawings and will be explained in more detail in the following. In the drawings.

DETAILED DESCRIPTION OF PREFERRED EMBODIMENT

Figure 1:
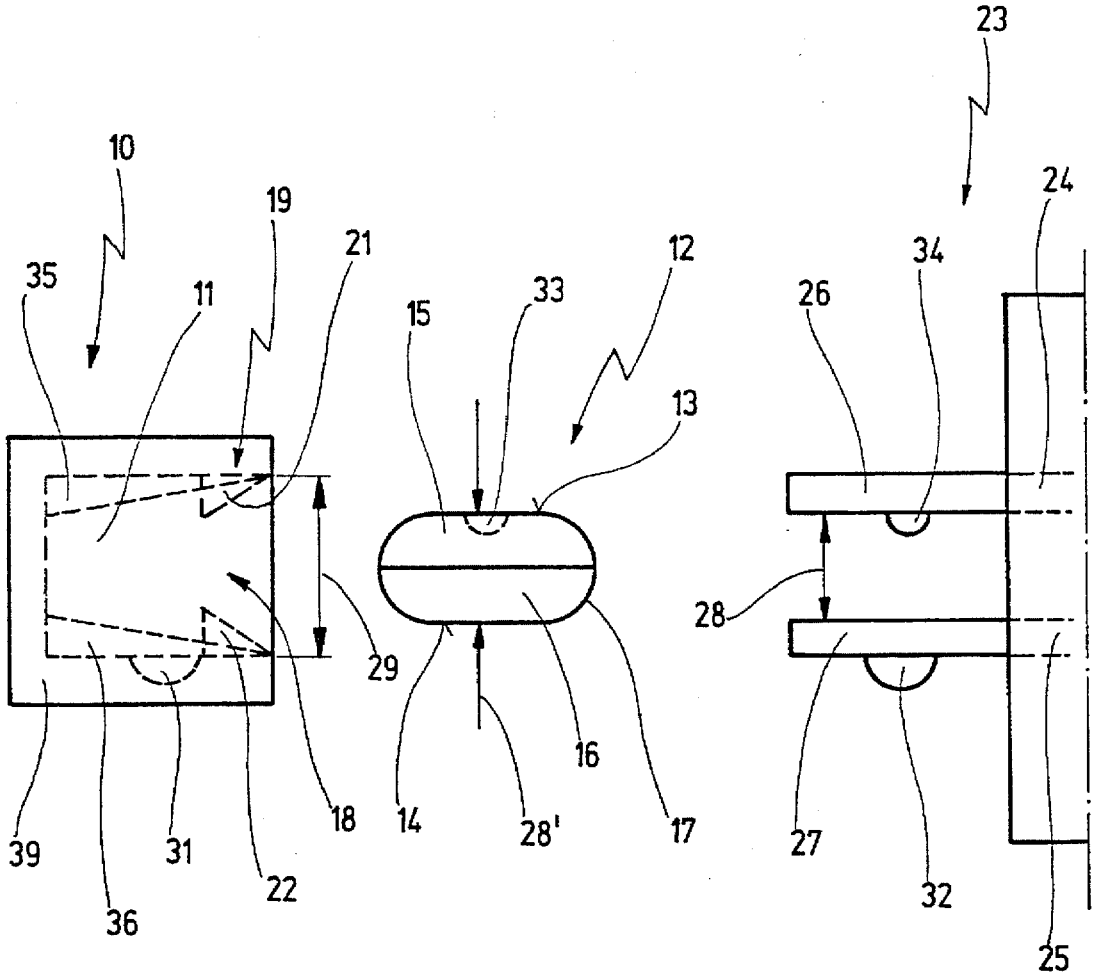
FIG. 1 is a side view of an exploded diagram of the new insulating housing, switch and holder.

FIG. 1 generally shows a new insulating housing 10 which displays an inner space 11 to receive a switch 12 with a temperature-dependent switching device.

The switch 12 shown in FIG. 1 to the right of the insulating housing 10 comprises an upper terminal area 13 and a lower terminal area 14 which are part of an electrically conductive cover 15 and electrically conductive base 16, which is insulated from the cover 15 in a known manner. The cover 15 and base 16 form an encapsulated housing 17 in which the temperature-dependent switching device is arranged in a familiar manner.

The insulating housing 10 displays an opening 18 containing a snap-in locking device 19 in the form of snap-in lugs 21 and 22. The switch 12 can be inserted into the inner space 11 through this opening 18 where it is then held by the snap-in lugs 21 and 22, albeit loosely.

A holder 23 is shown in the right of FIG. 1 which is part of a consumer or is suitable for connection to a consumer to be protected. The holder 23 has two contact parts 24, 25 which in this case are terminal lugs 26, 27. The broad sides of the terminal lugs 26, 27 face each other and have a clearance 28 which corresponds to the thickness or height of the switch 12 indicated by 28'. The opening 18 in the insulating housing 10 on the other hand has a clearance 29 which is dimensioned so that the terminal lugs 26, 27 can still be inserted into the insulating housing 10 when the switch 12 has been positioned in the inner space 11.

Furthermore, there is a snap-in locking element 31 in the form of a recess on the inside 11 of the insulating housing 10 which interacts with a further snap-in locking element 32 on the terminal lug 27 in such a way that an insulating housing 10 which is pushed onto the terminal lugs 26, 27 is clamped firmly in place.

Two further snap-in locking elements 33, 34 are arranged in the cover 15 of the switch 12 and terminal lug 26 in such a way the insulating housing 10 is also captured in the holder 23 by the switch 12 which is clamped within the housing.

Following assembly in the manner described above the terminal lug 26 rests against the cover 15 whereas the terminal lug 27 rests against the base 16. In order to improve the electrical contact between the terminal areas 13, 14 and the terminal lugs 26, 27 the insulating housing 10 has guide bevels 35, 36 which are inclined towards the inner space 11. The terminal lugs 26, 27 are pressed against the terminal areas 13, 14 by these guide bevels 35, 36 so that the electrical contact between these parts is further improved. However, the insulating housing 10 is not pushed away from the holder 23 by the forces which are exerted since it is held firmly in place by the snap-in locking elements 31, 32, 33, 34, as already described above.

Figure 2:
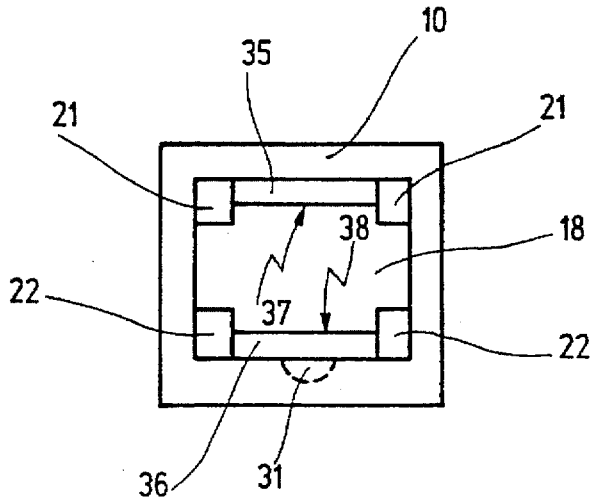
FIG. 2 is a top view seen from the right of the insulating housing in FIG. 1.

In FIG. 2 it can be seen that guide channels or grooves 37, 38 are formed between the snap-in lugs 21 and 22 through which the terminal lugs 26, 27 are guided when the insulating housing 10 is mounted.

The insulating housing 10 is an injection moulded plastic part made from one piece which can be produced very economically as a mass-produced article.

Figure 3:
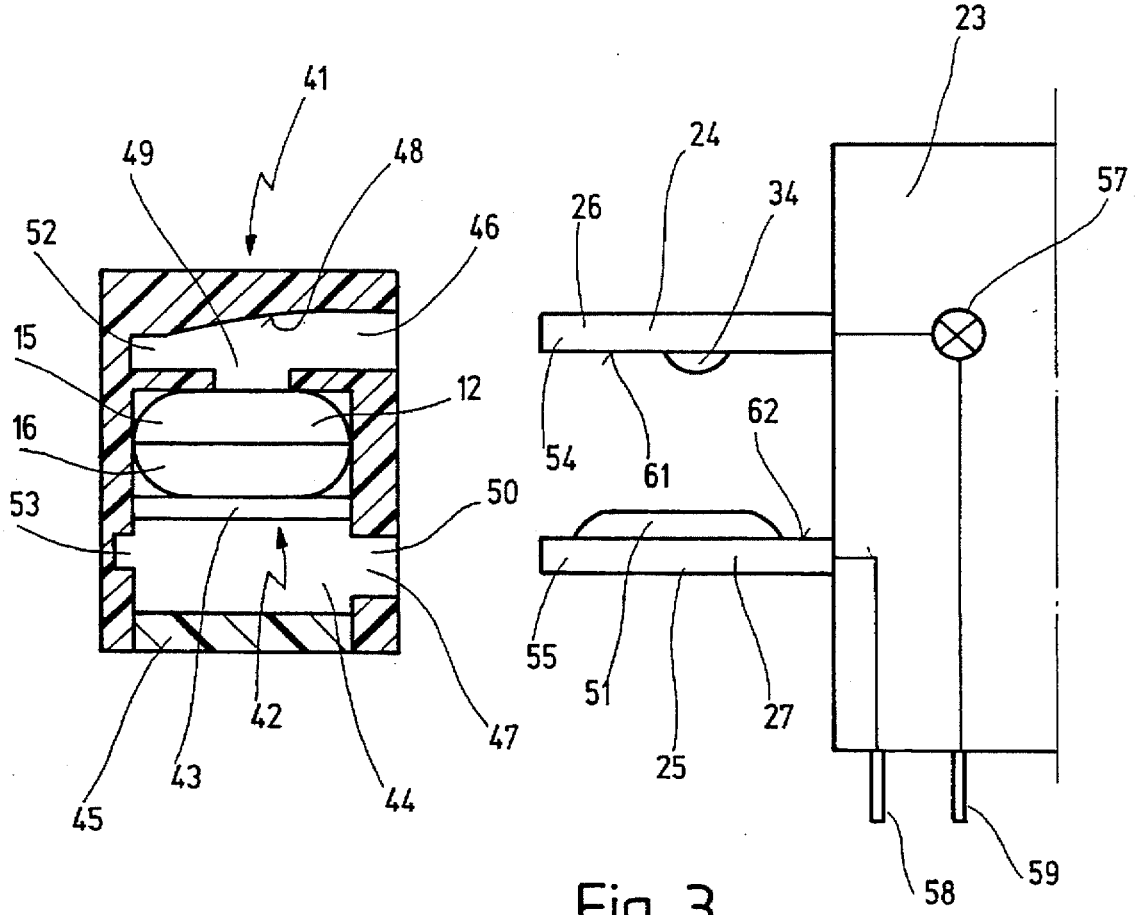
FIG. 3 is a sectional view of a further insulating housing shown from the perspective of FIG. 1 which bears a switch and showing a corresponding consumer

FIG. 3 shows a further insulating housing 41 in whose inner space 42 a switch 12 is indicated. The switch 12 is held firmly in the inner space 42 by a snap-in lug 43, which functions in the same way as the snap-in lugs 21, 22 in the insulating housing 10. The switch 12 is inserted into the inner space 12 from below through an opening 44 until the snap-in lug 43 is covered. The inner space 42 can then be closed with a cover 45.

The insulating housing 41 also displays guide channels 46, 47 into which the terminal lugs 26, 27 are inserted. The upper guide channel 46 hereby has a curved guide surface 48 which bends the terminal lug 26 down during insertion into the guide channel 46 in FIG. 3 so that its snap-in locking element 34 makes contact with the cover 15 of the switch 12 through a snap-in hole 49. This ensures not only a mechanical catch but at the same time a very good electrical contact. In the embodiment shown in FIG. 3 the lower terminal lug 27 has a snap-in locking part 51 which makes contact with the base 16 of the switch 12 when the insulating housing 41 is mounted. In order to enable the consequently thicker terminal lug 27 to be inserted into the guide channel 47 this has an enlarged insertion opening 50.

The guide channels 46, 47 end in grooves 52, 53 in which the front ends 54, 55 of the terminal lugs 26, 27 rest when the insulating housing 41 has been correctly mounted. These grooves 52, 53 ensure that electrical contact is retained between the terminal lugs 26, 27 and the switch 12 even during serious vibrations or other mechanical loads.

Since the opening 44 runs vertical to the guide channels 46, 47 the inserted contact parts 24, 25 also ensure a mechanical retention of the switch 12 so that the snap-in lug 43 is not required if the switch 12 and insulating housing 41 are to be stored separately.

In the embodiment shown in FIG. 3 the holder 23 is arranged on a consumer 57 which has two terminal elements 58, 59 for connection to an external electric circuit. Whereas the terminal element 59 is directly connected to the electrical consumer 57, the terminal element 58 is electrically connected to the terminal lug 27. The second terminal lug 26, on the other hand, is directly connected to the electrical consumer 57. This arrangement means that a switch 12 held between the terminal lugs 26, 27 is connected in series with the consumer 57 between the terminal elements 58, 59. It should also be mentioned that the broad sides 61, 62 of the terminal lugs 26, 27 face each other.

What I claim is:

1. Insulating housing for accommodating and mechanically and/or electrically protecting a switch assembly, said switch assembly comprising a temperature-dependent switching device and two electrically conductive connection areas, said connection areas provided for making electrical contact between said switch assembly and contact parts of a holder or an electrical consumer to be protected by the switch assembly against excess temperature and/or overload current;

said housing comprising an inner space for accommodation of said switch assembly and at least one opening leading into said inner space;

said opening adapted for the insertion of said contact parts into said inner space, such that the contact parts make direct electrical and mechanical contact to said connection areas of said switch assembly when accommodated in said inner space prior to insertion of said contact parts.

2. The insulating housing in accordance with claim 1, characterized in that it comprises an internal profile which presses the inserted contact parts against the connection areas.

3. The insulating housing in accordance with claim 2, characterized in that it comprises at least one snap-in locking device for locking with a corresponding snap-in element on one of the contact parts.

4. The insulating housing in accordance with claim 1, characterized in that it has snap-in locking devices for capturing an inserted switch assembly.

5. The insulating housing in accordance with claim 1, characterized in that it comprises guide channels or grooves for receiving the contact parts.

6. The insulating housing in accordance with claim 5, characterized in that the guide channels or grooves comprise a guide surface which is longitudinally inclined towards the inner space.

7. The insulating housing in accordance with claim 6, characterized in that the guide surface is curved in a longitudinal direction.

8. The insulating housing in accordance with claim 1, characterized in that it comprises a further opening through which the switch assembly can be inserted into the inner space.

9. The insulating housing in accordance with claim 5, characterized in that the further opening is vertical to the guide channels and/or grooves.

10. The insulating housing in accordance with claim 8, characterized in that the further opening is vertical to the guide channels and/or grooves.

* * * * *